US006092334A

United States Patent [19]

Kim

[11] Patent Number: 6,092,334

[45] Date of Patent: Jul. 25, 2000

[54] DOOR LOCKING DEVICE FOR A DOOR CLOSER HAVING A FIRE ACTUATED MECHANISM FOR UNLOCKING THE DOOR LOCKING DEVICE

[76] Inventor: Young Jo Kim, 415-201, Bokhyun-Jugong Apt., Bokhyun-2dong, Buk-gu, Taegu Ci, Rep. of Korea

[21] Appl. No.: 09/165,319

[22] Filed: Oct. 2, 1998

[30] Foreign Application Priority Data

Oct. 2, 1997 [KR] Rep. of Korea ..... 97-51390
Dec. 16, 1997 [KR] Rep. of Korea ..... 97-73866

[51] Int. Cl.[7] ..... E05F 15/20; E05D 11/10

[52] U.S. Cl. ..... 49/8; 49/1; 49/7; 16/48.5; 16/334

[58] Field of Search ..... 16/48.5, 331, 332, 16/334; 49/394, 395, 1, 7, 8

[56] References Cited

U.S. PATENT DOCUMENTS

| | | | |
|---|---|---|---|
| 1,180,669 | 4/1916 | Oellrich et al. | 296/92 |
| 1,210,234 | 12/1916 | Towles | 16/334 |
| 1,687,174 | 10/1928 | Mountford et al. | 16/334 |
| 1,816,392 | 7/1931 | Moore | 16/48.5 |
| 1,993,224 | 3/1935 | Moore | 16/48.5 |
| 2,465,088 | 3/1949 | Gussack | 217/60 C |
| 3,964,125 | 6/1976 | Tansley | 16/48.5 |
| 3,983,599 | 10/1976 | Takashiro | 16/48.5 |
| 4,114,235 | 9/1978 | Remington | 16/321 |
| 4,121,319 | 10/1978 | Welch | 16/66 |
| 4,237,578 | 12/1980 | Welch | 16/48.5 |
| 4,491,355 | 1/1985 | Marinoni | 292/263 |
| 4,656,690 | 4/1987 | Katagiri et al. | 16/48.5 |
| 4,715,146 | 12/1987 | Atsumi et al. | 49/1 |
| 4,829,633 | 5/1989 | Kassner | 16/332 |
| 5,412,842 | 5/1995 | Riblett | 16/334 |
| 5,551,187 | 9/1996 | Brouwer et al. | 49/1 |

FOREIGN PATENT DOCUMENTS

| | | | |
|---|---|---|---|
| 61519 | 11/1943 | Denmark | 16/331 |

*Primary Examiner*—Daniel P. Stodola
*Assistant Examiner*—Gregory J. Strimbu
*Attorney, Agent, or Firm*—Birch, Stewart, Kolasch & Birch, LLP

[57] ABSTRACT

A door locking device for locking a door in predetermined, opened positions and automatically unlocking the door from the open positions in the event of a fire. The door locking device comprises a rotating body which includes channels and a support body which includes guide grooves separated by locking grooves. The rotating body and support body are operatively connected together. A locking device which includes locking balls mounted on springs extends through the channels for selective spring biased engagement of the locking balls with the locking grooves or guide grooves of the support body. A heat detection device is operatively connected to the locking device, the heat detection device including a heat-sensitive material. If the door locking device is exposed to a predetermined amount of heat, the heat-sensitive material loses its shape, causing the locking device to permit the locking balls to move from the locking grooves to the guide grooves for releasing the locking device.

3 Claims, 7 Drawing Sheets

DOOR LOCKING DEVICE FOR A DOOR CLOSER HAVING A FIRE ACTUATED MECHANISM FOR UNLOCKING THE DOOR LOCKING DEVICE

BACKGROUND OF THE INVENTION

1. Field of the Invention

The present invention relates to an improved door locking device for a door closer and more particularly to a door locking device for fixing the door at predetermined angles. The locking device is for being installed between an arm which is attached to the door and a door frame and is provided with a heat detection device for automatically unlocking the door in case of a fire.

2. Description of Related Art

Door locks are generally divided into those for a general door and those for a fireproof door. The door closer provides a door, which can be fixed at a predetermined angle by adopting a locking function, an automatic closing function. The fireproof door has the function of releasing the lock automatically as a soluble body of a heat detection fuse is melted due to a temperature rise when a fire occurs while the door is open.

Various kinds of door closers with closing functions have been developed in the past, but most of them are integrally fabricated by adding a locking function and a fireproof door function to the automatic closing function which is the original function of the door closer. Such closers have a lot of defects. That is, they enable locking by the frictional force between a plate spring and a lock projection and by frictional force between the engaged gears so that locking can be performed at only one position which is very inconvenient in use. Also, the locking direction is set in only one direction without compatibility so that the left and right components must be fabricated separately, which requires increased fabrication cost.

In addition, during the lock and lock release operation, the operation is not smooth but very noisy due to friction between the lock projection and the gear.

In particular, since the door lock device is integrally fabricated with a door closer, in the case of providing a fireproof door function, it must be fabricated separately from a general door closer so that locking may be automatically released by inter-operation using a heat detection fuse which requires additional fabrication cost. Even though the friction force is reduced by the melting of a heat detection fuse, due to fire, locking between a plate spring, a lock projection and a gear which are already locked, is not released easily by reducing the frictional force. Thus, there is the concern of a malfunction and the occurrence of a malfunction is directly associated with a large fire.

SUMMARY OF THE INVENTION

Accordingly, it is an object of the present invention to provide a door locking device for a door closer which eliminates the above problems encountered with conventional door locking devices.

Another object of the present invention is to provide a door locking device for a door closer which is installed between the door closer and a door frame by being fabricated separately from the door closer to enable the locking of the door in at least two open positions, with left and right compatibility and a smooth lock and release action. The door locking device is fabricated without separate consideration as a general door and a fireproof door by providing a fireproof door function utilizing a heat detection fuse to perform the function of quickly and automatically releasing the locking function of the door in the case of a fire.

A further objection of the present invention is to provide a door locking device for a door closer, which has a fireproof door function by installing a lock ball with spring on a rotation body which is connected to the arm of the door closer. A long guide groove and a locking groove are disposed along the circumference of the support body for adjustment which supports springs and locking balls and adjusts the elasticity of the locking ball in the bottom of a rotating body utilizing an adjustment bolt. A heat detection fuse is secured to the adjustment plate by the adjustment bolt.

Still another object of the present invention is to provide an improved door locking device for a door closer in the case where the door is opened and closed within a predetermined opening angle permitting a person to enter. Thus a locking ball moves within a guide groove to cause no hindrance to the automatic closing function of the door. When the door is opened to more than the predetermined opening angle, the locking ball in the guide groove moves over the locking frame to be locked within a locking groove so that the door is locked in the open position. At this time, if the door is pulled to a closing direction, the locking ball moves over the locking frame again so that the locking function is released.

Yet another object of the present invention is to provide a door locking device having a fireproof door function, wherein a heat detection fuse is operatively associated with an adjustment plate to adjust the elasticity of a spring communicating with the locking device. If the fuse is widened due to the melting of a body, in the case where a fire occurs, the spring elasticity is reduced due to a gap created by the melting operation so that the locking operation of the locking ball is automatically released. Such locking and releasing action is performed smoothly by the rolling action of the locking ball which moves along the guide groove and into an end of the locking groove. At this time, it is desirable to install two or more rotation body locking balls in order to maintain balance during contact with a support body due to rotation action, and it is supposed to set the number of the guide grooves and the locking grooves of the support body corresponding to the number of locking balls. The locking of the door is divided into several steps depending on the number of locking grooves of the support body. At least two locking steps become possible by utilizing the guide grooves and a locking groove corresponding to said locking ball. Left and right compatibility is created by forming the guide groove and the locking groove of the support body in turn.

A further object of the present invention is to provide a door locking device wherein the door locking is set at several opening angles. Such a fine adjustment is needed in order to perform locking at the desired opening angle, during installation, whereby such a fine adjustment may be achieved by making a plurality of adjustment holes in the connection plate connected to a support body, and by providing bolt holes in the support body for reducing the adjustment angle. Therefore, the door locking device of the present invention enables locking at two or more places while the locking ball installed with an elastic spring to a rotation body moves around the guide groove and locking groove of the support body during the door opening and closing operation, and provides a satisfactory result for a structure having a fireproof door function by securing a detection fuse to an adjustment plate with an adjustment bolt to adjust the elasticity of the spring.

Still another object of the present invention is to provide a door locking device for a door closer, which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

Figure 1:
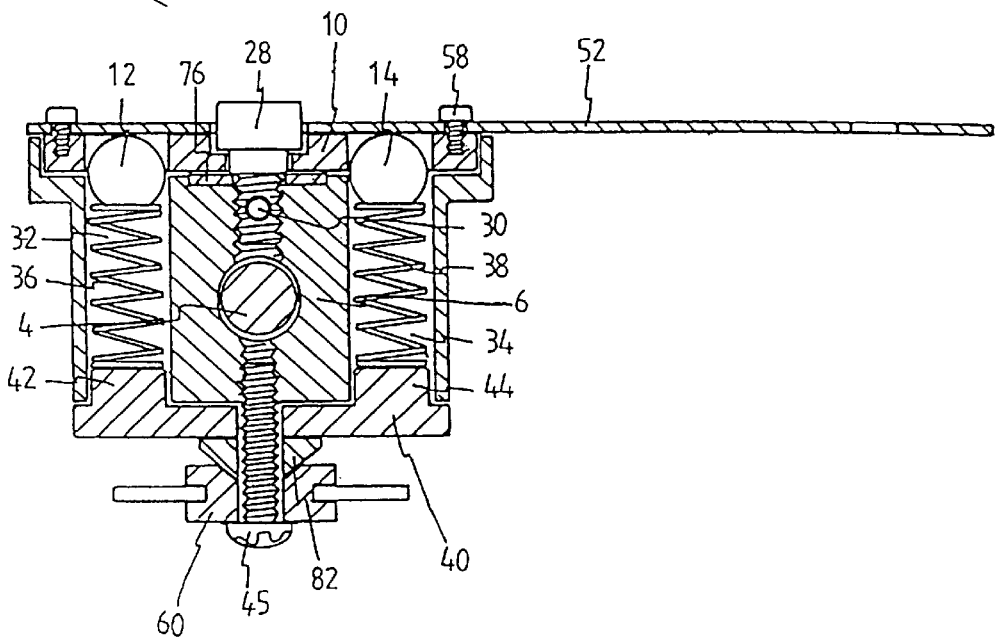
FIG. 1 is a sectional view of the door locking device for a door closer according to the present invention.

Referring now in detail to the drawings for the purpose of illustrating the preferred embodiment of the present invention, the door locking device 86 for a door closer as shown in FIGS. 1, 2, 3, 4 and 5, includes a rotation body 6 connected to an arm 4 of a door closer 2 which is installed with support body 10 fixed to a door frame 8. Locking balls 12 and 14 are installed on the rotation body 6 to move along the long guide grooves 16 and 18 and locking grooves 20 and 22 formed along the circumference of the bottom surface of the support body 10. The rotation body 6 rotates relative to the support body 10 for performing the locking and releasing action.

The support body 10 is connected to the rotation body by a wrench bolt 28 containing a support frame 26 for maintaining a gap when the support body 10 is inserted into a circular connection groove 24 in the top of the rotation body 6. Relaxation of the wrench bolt 28 is prevented by inserting a fixing pin 30 through the wrench bolt and the interlocking hole of the rotation body 6.

The locking balls 12 and 14 of the rotation body 6 are installed with springs 36 and 38 and disposed in channels 32 and 34 disposed in the body 6. At this time, studs 42 and 44 of an adjustment plate 40 are inserted into the bottom of the channels 32 and 34 to support the springs 36 and 38, and the adjustment plate 40 is secured by an adjustment bolt 45 through a hole 43.

The locking balls 12 and 14 of the rotation body 6 move along guide grooves 16 and 18 and into locking engagement with the locking grooves 20 and 22 of the support body 10 during the rotational action of the rotating body 6 for performing a locking and releasing action. A smooth operation may be expected only if two or more locking balls are utilized, but if an excessive number is utilized, the door locking angle is reduced gradually so that it is desirable to install the minimum number of locking grooves to maintain balance.

Figure 2:
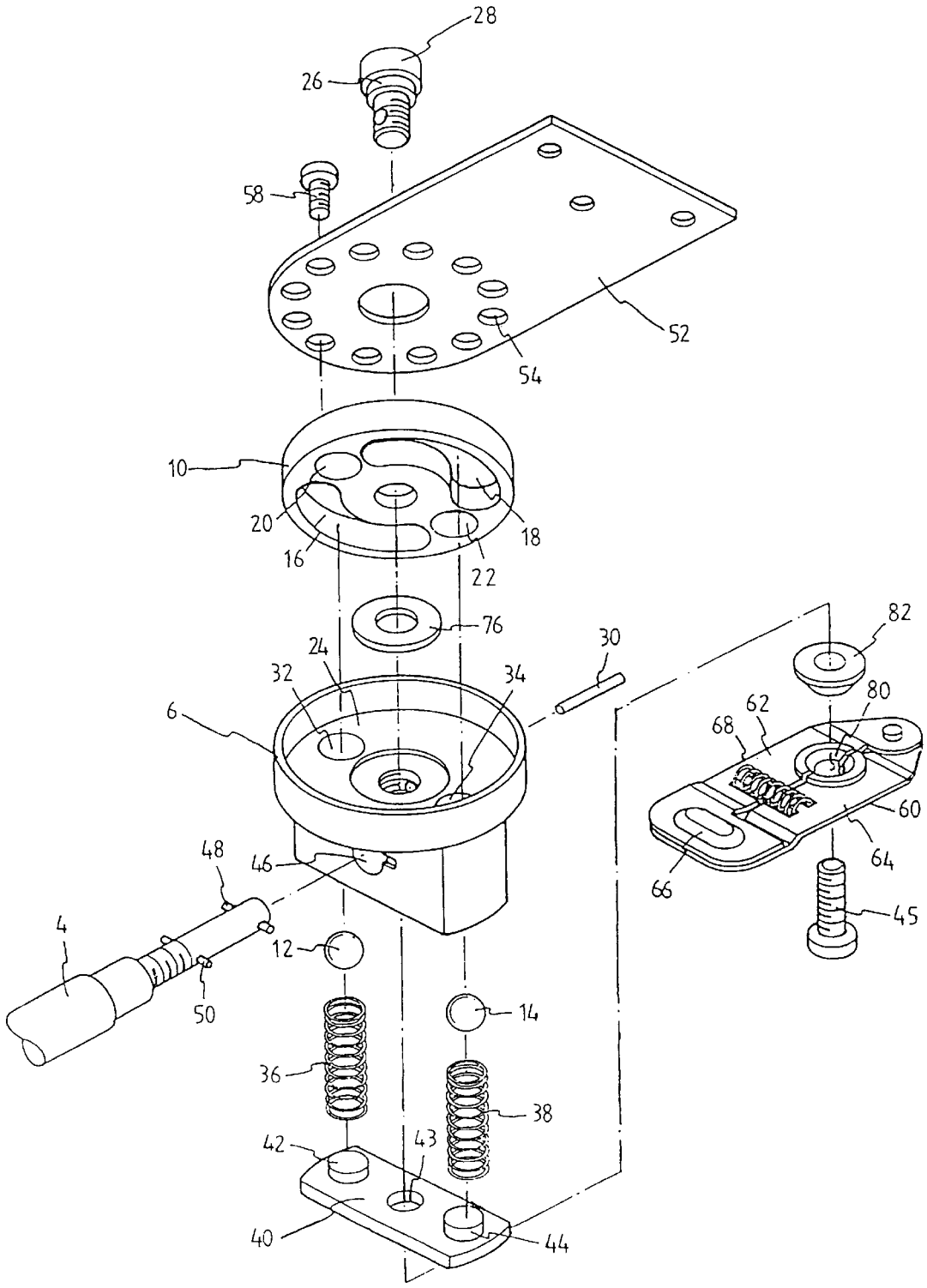
FIG. 2 is an exploded, perspective view of the door locking device for a door closer according to the present invention.

Also, if the guide grooves 16 and 18 and the locking grooves 20 and 22 of the support body 10 are formed in the upper and lower surfaces of the support body 10 as shown in FIG. 2, the manufacturing cost can be reduced. The support body 10 should be formed with a proper thickness by considering the diameter of the locking balls 12 and 14 so that the tops of the balls can be effectively engaged in order to prevent a separation of the locking balls 12 and 14 from the support body 10.

When connecting the arm 4 of the door closer 2 to the rotational body 6, locking projections 48 and 50 are connected to both sides of a connecting hole 46 disposed in the rotational body 6. Thus, the arm 4 with protruding, locking projections 48 and 50 engages the rotating body 6 through connection hole 46, where it can be twisted approximately 90° degrees.

Figure 3:
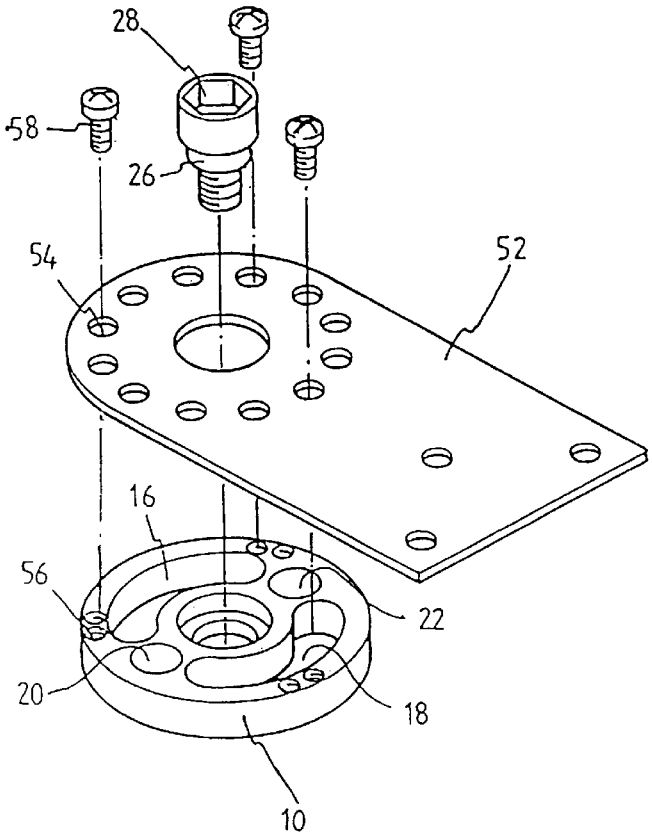
FIG. 3 is a partially exploded, perspective view of the door locking device for a door closer according to the present invention.

FIG. 3 shows a connection means for connecting the support body 10 to the door frame 8. A connection plate 52 is fabricated separately from the support body 10 and contains adjustment holes 54 disposed along the circumference thereof. A plurality of bolt holes 56 are provided on the top of the support body 10 so that an angled adjustment may be provided utilizing a plurality of fixing bolts 58. The body 10 is attached to the door frame 8 through the connection plate 52.

In order to provide a fireproof door function according to the present invention, an adjustment plate 40 is installed with a heat detection fuse 60 by inserting the adjustment bolt 45 into the hole before assembling the adjustment plate 40.

The heat detection fuse 60 containing support plates 62 and 64 and a spring 68 has a soluble body 66 connected to said support plates which melts to produce a gap of a corresponding thickness. The tightening force of the adjustment bolt 45 is relaxed to the extent of the gap created when the heat detection fuse 60 is melted. Therefore, the adjustment plate 40 fails to support the springs 36 and 38 since the adjustment bolt 45 is relaxed, whereby the locking action is automatically released.

Figure 12:
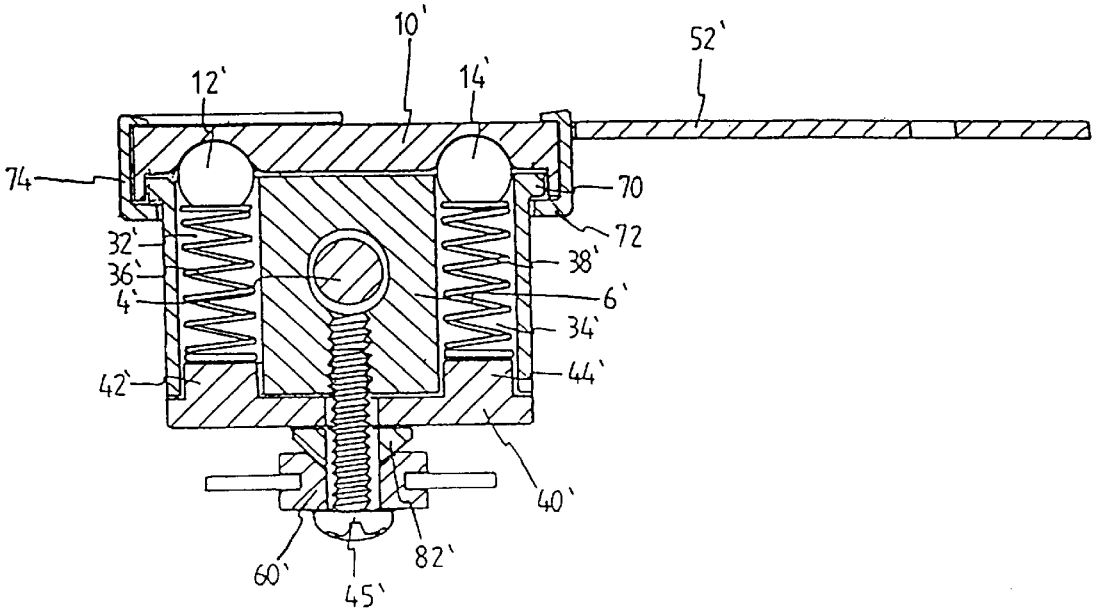
FIG. 12 is a sectional view of an additional embodiment of the locking device for a door closer according to the present invention.
Figure 10:
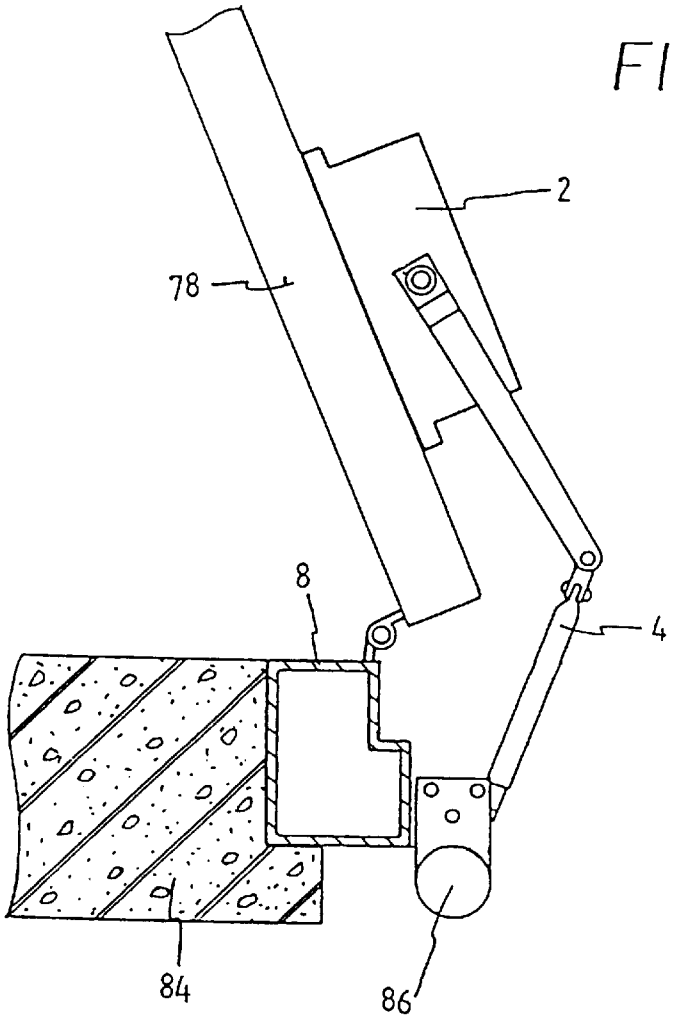
FIG. 10 is a sectional front elevational view of the door locking device for a door closer in a second locking state of the door according to the present invention.
Figure 11:
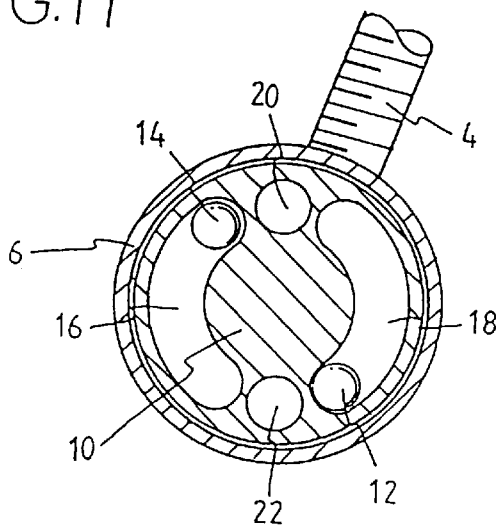
FIG. 11 is a sectional view of the door locking device for a door closer showing the position of the locking ball in FIG. 10.
Figure 13:
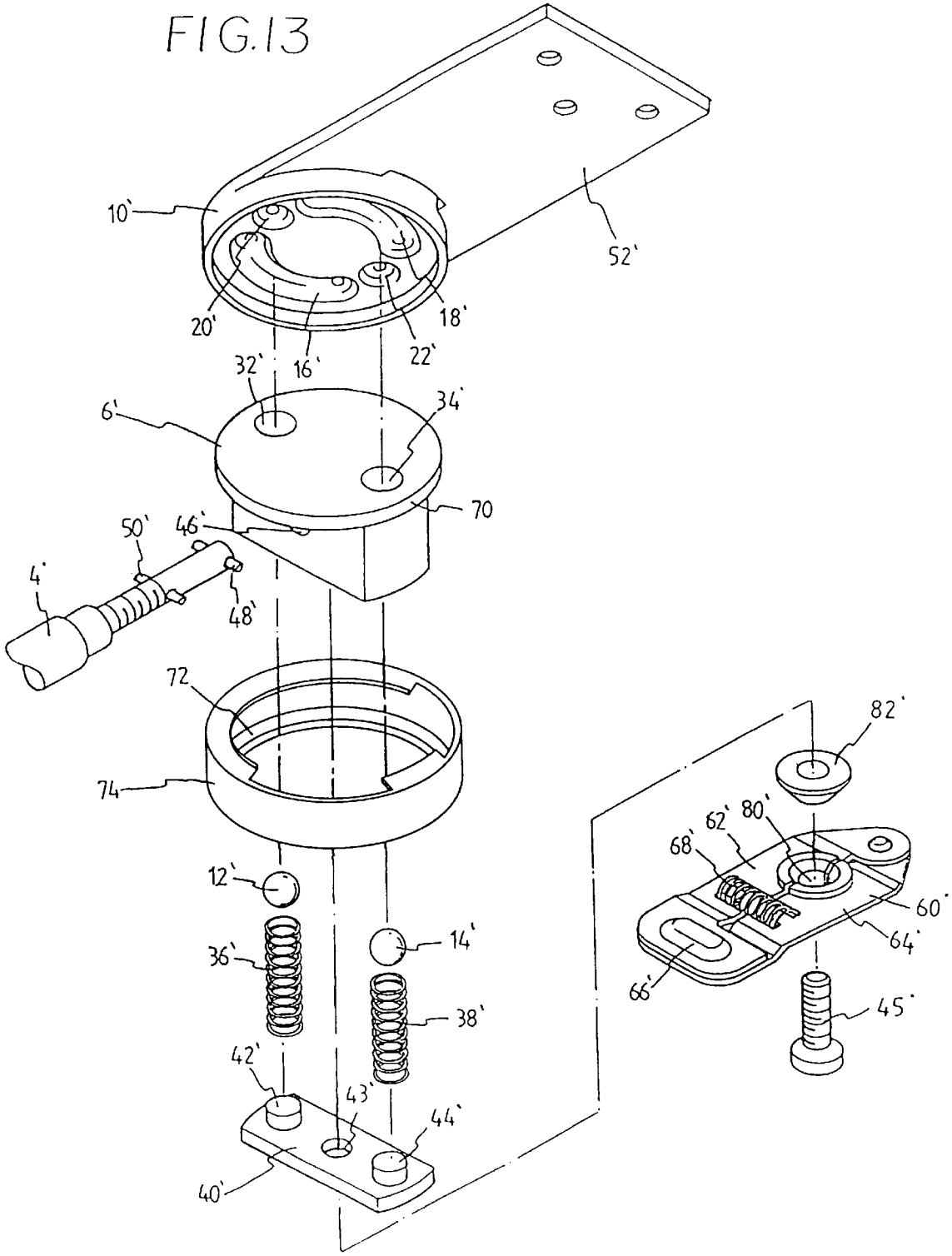
FIG. 13 is an exploded perspective view of the additional embodiment of the door locking device for a door closer according to the present invention.

FIGS. 12 and 13 show an additional embodiment of the present invention for connecting the rotation body 6 and the support body 10. A locking frame 70 is formed around the top of the rotation body 6' and connects with case 74 and frame 72 to the support body 10' so that the rotation body 6' may be rotated from the support body 10'. The locking balls 12' and 14' installed in the rotation body 6' also move around guide grooves 16' and 18' and locking grooves 20' and 22' of the support body 10' for performing the locking function. The lock has the function of a fireproof door by installing the heat detection fuse 60' with the adjustment bolt 45' which connects with the adjustment plate 40'. Element 76 is a wearproof plate; 78 a door, 80 and 80' heat detection fuse holes; 82 and 82' fuse openings and 84 a wall. Furthermore, 4' is an arm; 32' and 34' are channels; 42' and 44' are studs; 43' is a hole; 46' is a connecting hole; and 48' and 50' are locking projections. The bodies 10, 10', respectively, or locking must be performed with the locking grooves 20, 20' and 22, 22' depending on the open and closed level of the door 78.

Figure 4:
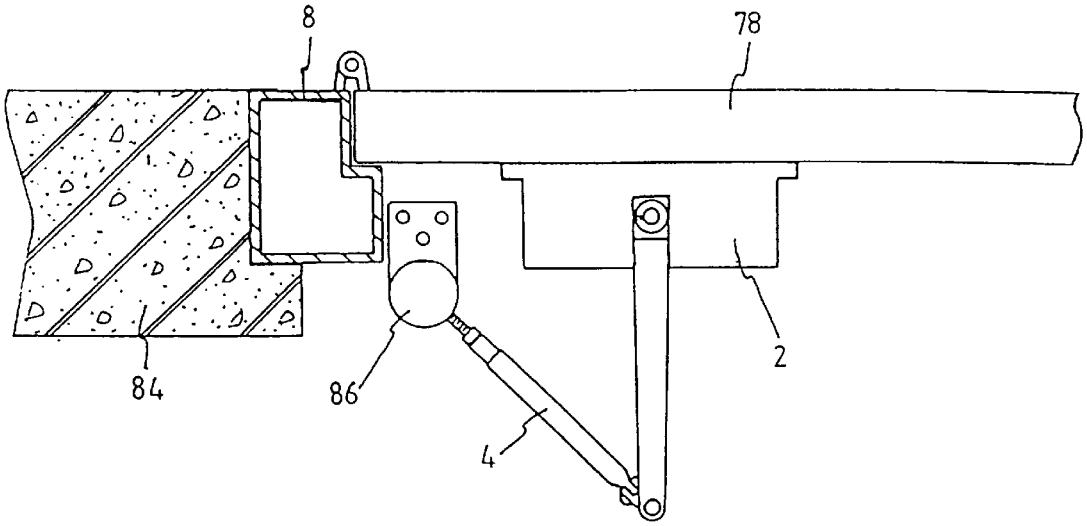
FIG. 4 is a sectional top elevational view of the door locking device for a door closer in a state where the door is locked.
Figure 6:
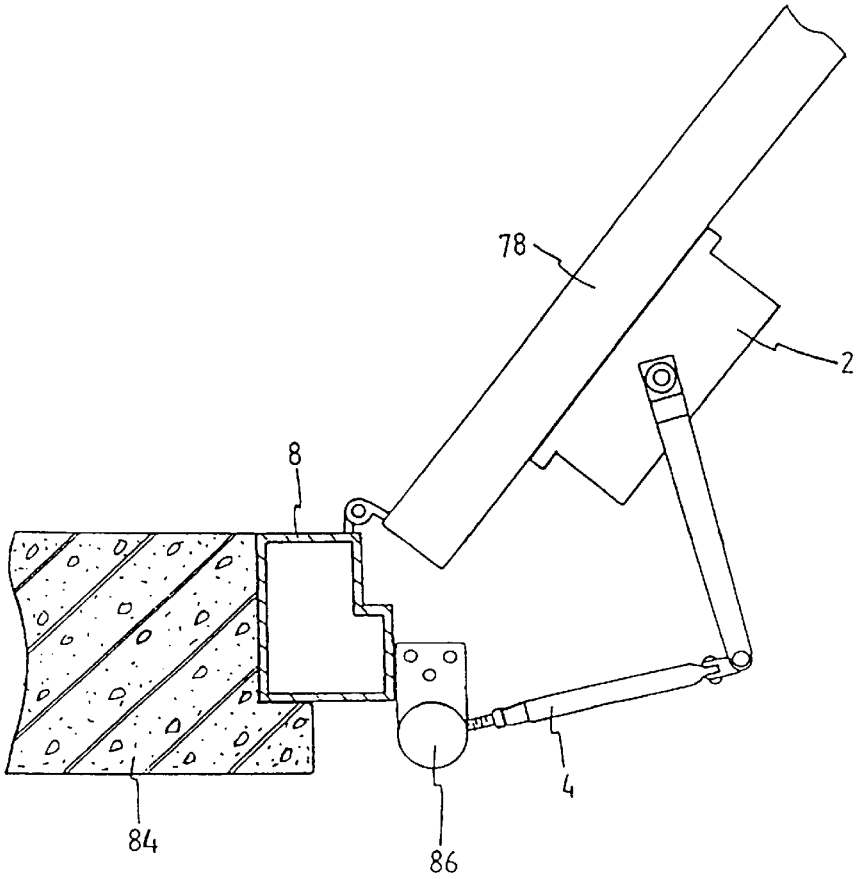
FIG. 6 is a sectional top elevational view of the door locking device for a door closer before the door locking state.
Figure 5:
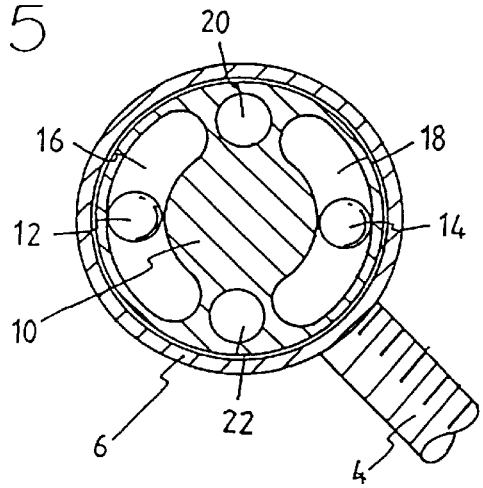
FIG. 5 is a sectional top elevational view of the door locking device for a door closer indicating the position of a locking ball in FIG. 4.
Figure 7:
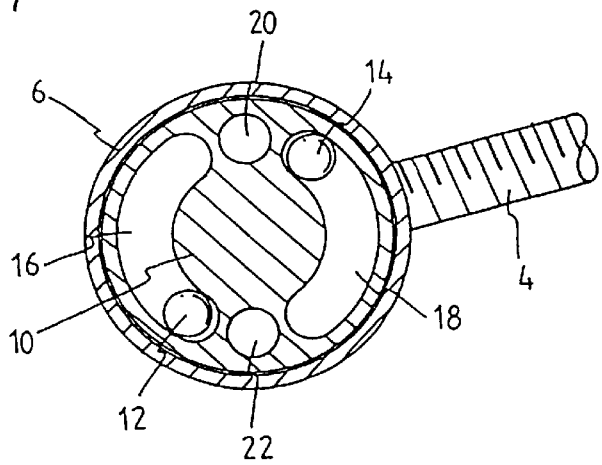
FIG. 7 is a sectional view of the door locking device for a door closer showing the position of the locking ball in FIG. 6.
Figure 9:
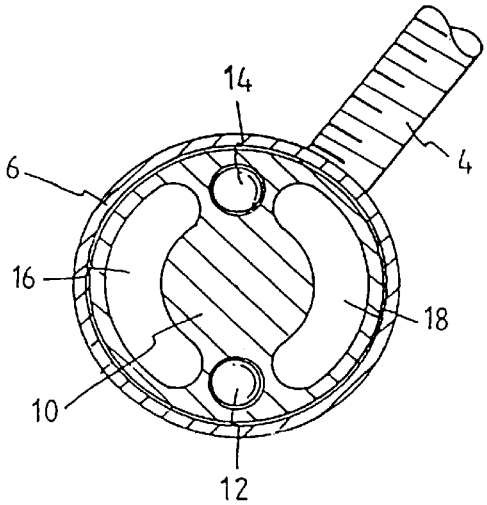
FIG. 9 is a sectional view of the door locking device for a door closer showing the position of the locking ball in FIG. 8.
Figure 8:
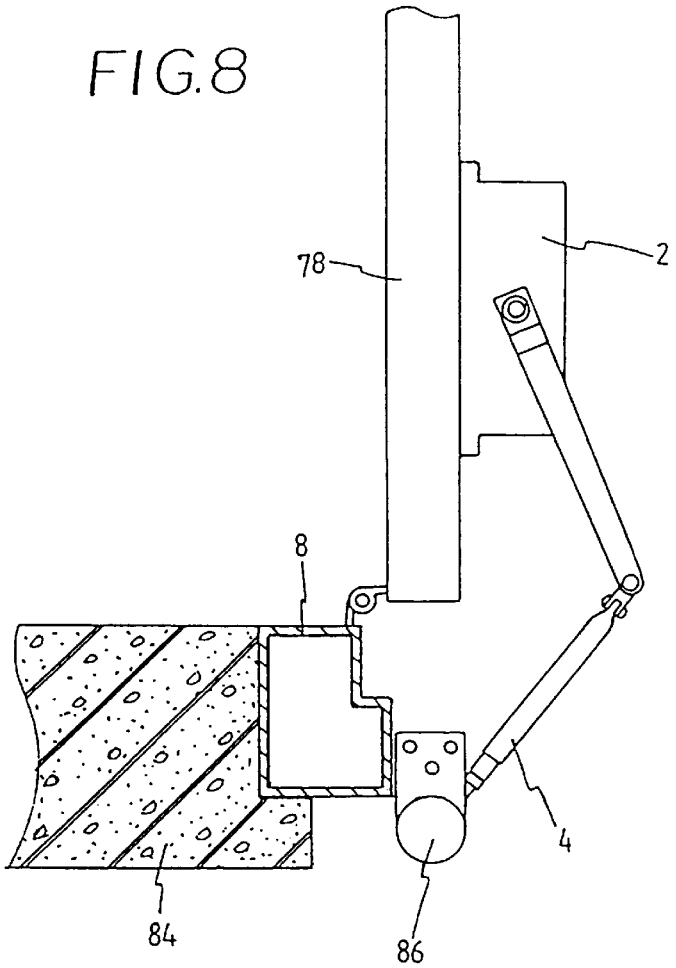
FIG. 8 s a sectional, top view of the door locking device for a door closer in the first locking state of the door according to the present invention.

That is, in the case where the door 78 is closed as shown in FIG. 4 or the door 78 is opened to a proper opening angle as shown in FIG. 6, the locking balls 12, 12' and 14, 14' of the rotation bodies 6, 6' remain in the guide grooves 16, 16' and 18, 18' of the support bodies 10, 10', respectively, so that the automatic closing function of the door closer 2 may be expected without hindrance from the surroundings.

Accordingly, when attaching the locking device 86 of the present invention to the door frame 8 by using the connection plates 52, 52', it must be installed so that the locking balls 12, 12' and 14, 14' of the rotation bodies 6 and 6' may remain within the guide grooves 16, 16' and 18, 18' of the support bodies 10 and 10' in a proper opening angle of the door 78. But locking is performed at desired opening angles only if the locking balls 12, 12' and 14, 14' are given a state just before separation of the guide grooves 16, 16' and 18, 18' in the maximum opening angle of the door 78.

If the door 78 is opened to a maximum opening angle for entrance, the rotation body 6, 6' rotates from support body 10, 10'. Therefore, the locking balls 12, 12' and 14, 14' of the rotation body 6, 6' pass over the locking frame 70 in a counterclockwise direction from the guide grooves 16, 16' and 18, 18' of the support bodies 10 and 10', respectively, to the locking grooves 20, 20' and 22, 22', so that the door 78 is fixed in an open position.

And, if the door 78 is further opened, the locking balls 12, 12' and 14, 14' of the rotation bodies 6 and 6' which are locked with the locking grooves 20, 20' and 22, 22', respectively, move further in counterclockwise direction to lock with the guide grooves 16, 16' and 18, 18' so that at least two locking steps may be possible. If the number of locking grooves 20, 20' and 22, 22' formed between the guide grooves 16, 16' and 18, 18' is increased, locking may be performed in several places.

If the elasticity of the springs 36, 36' and 38, 38' which support locking balls 12, 12' and 14, 14' is reduced unnecessarily during use or weakened due to long use, the elasticity of the springs 36, 36' and 38, 38' can be adjusted by adjusting the adjustment plate 40 and 40' by using the adjustment bolts 45 and 45'.

By pulling the locked door 78 in the locking direction, the locking balls 12, 12' and 14, 14' of the rotation bodies 6 and 6' pass over the locking frame in a clockwise direction from the locking grooves 20, 20' and 22, 22' of the support bodies 10 and 10' so that the locking function is released and the door is closed by the door closer 2 after releasing of locking.

The heat detection fuses 60 and 60' are connected by the adjustment bolts 45 and 45' to connect adjustment plates 40 and 40' to provide a fireproof door function, and at this time the elasticity of springs 36, 36' and 38, 38' is adjusted by the adjustment plates 40 and 40' according to the loosening or tightening of the adjustment bolts 45, 45'.

If the heat detection fuses 60 and 60' are inserted into the adjustment bolts 45 and 45' by using the connection holes 80 and 80' of the heat detection fuses 60 and 60', the meltable bodies 66 and 66' to connect left and right support plates 62, 62' and 64, 64' of the heat detection fuses 60 and 60' are melted by heat during occurrence of fire, so that the heat detection fuses 60 and 60' are widened left and right by the springs 68 and 68' installed between them. At this time, the adjustment bolts 45 and 45' are relaxed due to the occurrence of a gap which can be as thick as the space occupied by the connection part of the heat detection fuses 60 and 60'. The adjustment plates 40 and 40' secured by the adjustment bolts 45 and 45' fail to support the springs 36, 36' and 38, 38' because the adjustment bolts are relaxed, so that the locking balls 12, 12' and 14, 14' of the rotation bodies 6 and 6' locked within locking grooves 20, 20' and 22, 22' of the support bodies 10 and 10' have the function of a fireproof door where locking is automatically released due to weakness of elasticity of the springs 36, 36' and 38, 38', respectively.

Accordingly, the door locking device 86 of the present invention can open the door at several angles as necessary in order to keep the door opened, be used without left and right division, and allow locking while the locking balls 12 and 14 move around the guide grooves 16, 16' and 18, 18'. The locking grooves 20, 20' and 22, 22' to perform locking and releasing action smoothly, inserts the heat detection fuses 60 and 60' into the adjustment bolts 45 and 45' for connecting adjustment plates 40 and 40', respectively, so that it has the fireproof door function. This reduces manufacturing costs by being fabricated the same for a general door and a fireproof door, and be used reliably without a concern of malfunction because locking is immediately released due to the occurrence of gaps pursuant to melting of the soluble bodies 66 and 66' of the heat detection fuses 60 and 60' during the occurrence of fire.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A door locking device for locking a door in predetermined, opened positions and for unlocking the door from the predetermined, opened positions upon exposure to a predetermined amount of heat, said door locking device comprising:

a rotating body including channels formed therein, and a support body including guide grooves separated by locking grooves, said rotating body and said support body operatively connected together;

locking means including locking balls mounted on spring means extending through the channels for selectively spring biasing the locking balls into engagement with the locking grooves or the guide grooves of the support body; and heat detection means operatively connected to said locking means, said heat detection means containing a heat-sensitive material, wherein when the door locking device is exposed to said predetermined amount of heat, the heat-sensitive material melts, thereby permitting the locking balls to move from the locking grooves to the guide grooves for releasing the locking means.

2. The door locking device of claim 1, wherein the guide grooves are arcuate slots extending circumferentially around the support body and extending through the support body and the locking grooves are holes extending through the support body.

3. The door locking device of claim 1, wherein the heat-sensitive material is a solid material which melts upon exposure to said predetermined amount of heat.

* * * * *